US006261393B1

(12) United States Patent
Vestre

(10) Patent No.: US 6,261,393 B1
(45) **Date of Patent: *Jul. 17, 2001**

(54) WATER RESISTANT EXPLOSIVE COMPOSITION

(75) Inventor: Jan Hans Vestre, Reistad (NO)

(73) Assignee: Dyno Industrier ASA, Oslo (NO)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/147,954

(22) PCT Filed: Sep. 25, 1997

(86) PCT No.: PCT/NO97/00262

§ 371 Date: Mar. 24, 1999

§ 102(e) Date: Mar. 24, 1999

(87) PCT Pub. No.: WO98/13318

PCT Pub. Date: Apr. 2, 1998

(30) Foreign Application Priority Data

Sep. 27, 1996 (NO) ..... 964107

(51) Int. Cl.[7] ..... C06B 31/28

(52) U.S. Cl. ..... 149/46; 149/2; 149/21; 149/109.6; 149/112

(58) Field of Search ..... 149/2, 21, 46, 149/109.6, 112

(56) References Cited

U.S. PATENT DOCUMENTS

| | | | | |
|---|---|---|---|---|
| 4,409,044 | * | 10/1983 | Bhattacharyya et al. | 149/2 |
| 4,614,146 | * | 9/1986 | Ross et al. | 149/109.6 |
| 4,637,849 | * | 1/1987 | Harris, Jr. | 149/43 |
| 4,685,375 | * | 8/1987 | Ross et al. | 149/2 |
| 4,693,763 | * | 9/1987 | Ross et al. | 149/8 |
| 4,764,230 | * | 8/1988 | Bates et al. | 149/21 |
| 4,780,156 | * | 10/1988 | Sheeran et al. | 149/21 |
| 5,076,867 | * | 12/1991 | McKenzie | 149/2 |
| 5,480,500 | * | 1/1996 | Richard et al. | 149/46 |
| 5,486,247 | * | 1/1996 | Engsbraten | 149/46 |
| 5,490,887 | * | 2/1996 | Cranney et al. | 149/2 |
| 5,925,846 | * | 7/1999 | Richard et al. | 149/46 |
| 6,113,714 | * | 9/2000 | Richard et al. | 149/46 |

FOREIGN PATENT DOCUMENTS

31847/84B * 3/1985 (AU) .

* cited by examiner

*Primary Examiner*—Charles T. Jordan
*Assistant Examiner*—Glenda L. Sánchez

(57) ABSTRACT

A dry water resistant ANFO-explosive, containing one or more organic fuels, one or more inorganic salts, one or more water thickening agents, and a gas generating substance which develops a gas when it gets in contact with water in a blast hole, and thereby transforms itself into a watergel slurry.

6 Claims, No Drawings

WATER RESISTANT EXPLOSIVE COMPOSITION

Ammonium nitrate fuel oil explosives, hereafter called ANFO, have today a dominant position in the world's total use of commercial explosives. ANFO is basically made of two components, namely ammonium nitrate (AN) as oxidizer, and fuel oil (FO) as fuel.

The reason why ANFO has this dominant position as the worlds most used explosive, is mainly that the explosive consists of two rather cheap raw materials, besides being very easy to produce.

ANFO can either be produced in a factory, or be produced directly at the user's site. When produced at a factory, ANFO is usually filled in bags containing 25 or 1000 KGs.

ANFO prills have good flow properties, that is, they flow easily in pipelines, and they are specially well suited for bulk loading with pneumatic loading equipment. ANFO is then filled in a pressure vessel, usually called a "pressure pot", and compressed air with a pressure of 3–6 bar is applied. By means of a valve at the outlet of the pressure pot, which opens and closes, the ANFO is blown down to or into the bore holes.

The greatest disadvantage with the ANFO-explosives is their lack of water resistance. Usually this problem is solved by blowing the bore holes free for water by means of compressed air immediately before charging, and then carry out the blasting as soon as possible after loading. In many cases this method works well in order to charge ANFO in water filled bore holes, except for cases when cracks in the rock will lead the water into the bore hole after having loaded the ANFO.

Lots of work has been done in order to make the ANFO more water resistant. However, new additives that will make ANFO more water resistant, will at the same time result in both a more expensive and complicated product to manufacture. Consequently, the main advantage with ANFO, namely low price, will be reduced, and other water resistant explosive alternatives will become more competitive.

From the patent literature there are two known principles for making ANFO water resistant:

One of the methods recommends adding a certain percentage of an emulsion explosive to the ANFO. This is described in U.S. Pat. Nos. 4,111,727 and 4,181,546. The explosive resulting from this is called Heavy ANFO, and is usually classified as a special type of explosive. Besides, Heavy ANFO can not be loaded by means of pneumatic loading equipment. Normally, Heavy ANFO will not be considered as a water resistant ANFO.

The other method described is adding so called water thickening agents to the ANFO. These agents will then "react" with the water, making this highly viscous and thereby stopping further penetration of water into the product.

U.S. Pat. No. 4,933,029 describes a water resistant ANFO-explosive where the water resistance is achieved by using a water thickening agent like guar gum. In addition to this, it is known to use water repellent agents, like fatty acids, wax, etc. Also fillers like talc, glass, expanded perlite, sulphur, etc., may be used for preventing water to penetrate into the ANFO.

U.S. Pat. No. 5,480,500 describes such a water resistant ANFO-explosive. In this patent the water resistance is achieved by both applying a water thickening agent as guar gums and simultaneously adding a particulate filling agent, for instance pulverised ammonium nitrate in order to stop penetration of water into the ANFO.

The characteristic feature by applying above mentioned product in accordance with the technique already known, is the fact that one will allow some water to penetrate into the explosive, resulting in a reaction with the ANFO. This again will form a barrier against further water penetration. At areas where the water has "reacted" with ANFO in order to form a barrier against further water penetration, the ANFO in this area is damaged. The degree of water penetration into the ANFO is often used as a measure of how good the water resistant ANFO in question really is.

In U.S. Pat. No. 5,480,500 the water penetration in the ANFO is measured by pouring 100 ml cold water in the middle of an ANFO column which is filled in a 1000 ml graduated cylinder. During 15 seconds the water is carefully poured at top of the explosive column. The water resistant ANFO and the water is left for one hour, for thereafter to measure how deep the water has penetrated into the ANFO. The best result in the above mentioned patent was a water penetration of 5.5 cm. In bore holes with flowing water this means that the explosive will have a layer of 5.5 cm where the ANFO is damaged by water and cannot contribute to detonation. Furthermore, if one should put today's water resistant ANFO in a bore hole partly filled with water, the explosive would be mixing with the water, and one would have a mixture unable to detonate.

The present invention provides a water resistant ANFO-product which will detonate even when poured into a bore hole partly filled with water. Therefore, this concept is not based on the previously known principle that the water "reacts" with ANFO and forming a barrier for preventing further water penetration into the ANFO-explosive.

The invention with this current water resistant ANFO patent, is that it utilises water in the bore hole so that the dry ANFO and water in the borehole form a slurry. This water resistant ANFO may thus be described as an "instant slurry" of the watergel type.

A watergel-slurry is characterised by consisting of dissolved salts of nitrates and/or perchlorate, and the water content may vary from approx. 10 to 30%. The slurry is thickened with various types of gums and will also often contain some undissolved salt, usually ammonium nitrate. A watergel slurry is usually sensitised either by chemical gassing or by addition of porous particles such as hollow micro balloons or expanded perlite.

The water resistant ANFO in accordance with the current invention ("instant slurry") may therefore consist of the same components (except for water, which is present in the bore hole) known from the patent literature related to a watergel slurry.

In accordance to the current invention, it is possible to apply any chemical gassing reagent responding to water in the bore hole, which will develop gas bubble sensitising the explosive. Some examples of gassing reagents which may be used are: Sodium bicarbonate, aluminum, nitrite (particularly sodium nitrite) and calcium carbide.

In order to get the first three previous mentioned substances to respond to water developing a gas, the water has to have a low pH-level. Consequently, the bore hole water has to be made acidic by ensuring that the water resistant ANFO also contains an acid, lowering the pH-level sufficiently for a reaction and development of gas. It is preferred to use one or more of organic acids chosen amongst citric acid, tartaric acid, ascorbic acid or acetic acid. It may also be used an inorganic acid which lowers the water's pH in an adequate way.

The two last-mentioned gassing reagents will easily decompose or react, when stored for a longer period together with AN and small amounts of humidity always being present in the ANFO. These should therefore be given a protecting water soluble layer, for instance through a micro encapsulation process. Sodium bicarbonate ($NaHCO_3$) is the preferred gassing reagent because it is cheap, easy to use, and has storage stability together with ANFO. Sodium bicarbonate can be used in volumes from 0.1 to 10% by weight of the total mixture. The preferred volume is from 0.5% by weight to 5% by weight. Together with sodium bicarbonate it is preferred to use citric acid as a pH lowering agent, in amounts of 0.5 to 10% by weight of the total mixture. The preferred amount of citric acid used together with sodium bicarbonate is 2 to 7% by weight.

In combination with a gassing reagent, solid density reducing agents may be added. These agents are well known from the slurry literature and include hollow micro balloons, perlite, foamed glass, volcanic ash or other porous particles with open or closed pores which have an adequate low volume density.

As thickening agent for water in accordance with the invention, it may be used several different types and combinations. These are also known from the patent literature, both concerning water resistant ANFO and watergel slurry. Some examples of such thickening agents are: Guar gum, xanthan gum, CMC (carboxymethyl cellulose), various types of alginates and "super-absorbents" used in modern napkins and sanitary towels. These water thickening agents must tolerate salts in the water, and must have an ability to thicken the water with a suitable speed (that is during 1–10 minutes).

It is possible also to cross-link the thickened gum. As cross-linking agent may for example potassium pyroantimonat or sodium dichromate be used. Generally, the thickening agent(s) should be present in an amount of 0.1% to 10% based on the weight of the explosive mixture. The preferred amount will be from 2% by weight to 7% by weight.

When a water resistant ANFO, according to the invention, with added sodium bicarbonate and an organic acid is poured into a bore hole where water is present, for instance with water some meters from the bottom of the bore hole and up, the ANFO will sink to the bottom and expel the water upwards, at the same time as parts of the ANFO will start dissolving. The added acid will also dissolve in the water, and lower the pH so that sodium bicarbonate will start to decompose and develop $CO_2$-gas. The developed gas will force the water which is in the process of being thickened further up in the dry ANFO-column. This lowers the concentration of water in the bottom of the bore hole, and makes it more easy to detonate. In order to avoid too high water concentration in the bottom of the bore hole, the thickening agent should not thicken the water too fast, but gradually as the gassing develops and starts pushing the water further upwards into the dry ANFO-column. To avoid a too high water concentration in the bottom charge, it may also be beneficial to use an ANFO-mixture with partly crushed prills, because this will also expel the water more effectively.

EXAMPLES

To simulate a partly filled bore hole, we used a steel tube with a diameter of 64 mm and a length of 400 mm. The tube was filled with water up to a level of 65 mm above the bottom, that means approx. 16% of the tube length (or volume) was filled with water.

The various test explosives were poured directly into the water until this was expelled and then further until the tube was completely filled. The bottom of the tube was closed by means of a strong tape, and immediately after the tubes had been filled with ANFO, the top of the steel tube was closed with a second strong tape, which however, was perforated with small holes to let out the excess gas.

The steel tubes were test shot using a 150 gram primer attached to the bottom of the tubes, and the velocity of detonation (VOD) was measured at the uppermost 100 mm of the steel tube.

Table 1 shows results with some test mixtures compared to two of Scandinavia's commercially available water resistant types of ANFO, namely Aqanol and Solamon.

In the examples various water resistant ANFO mixtures were filled in 64 mm steel tubes which in advance had 16% of the total tube volume filled with water. The velocity detonating (VOD) was compared with the before mentioned commercial water resistant ANFO explosives, and with ANFO-mixtures without gassing reagent.

TABLE 1

The components are given in % by weight of the total mixture

| Example No. | 1 | 2 | 3[1)] | 4 | 5[1)] | 6[1)] |
|---|---|---|---|---|---|---|
| AN-pril | | | 83,5% | 85,5% | 84,0% | 86,0% |
| Fuel oil | | | 4,0% | 4,0% | — | 5,0% |
| Glycol | | | — | — | 9,0% | — |
| Urea | | | 2,0% | 2,0% | — | — |
| Guar gum F-21 | | | 4,0% | 4,0% | 4,0% | 4,0% |
| Citric acid | | | 4,0% | 4,0% | — | 3,0% |
| Tartaric acid | | | — | — | 1,5% | — |
| Sodium bicarbonate | | | 2,0% | — | 1,5% | 2,0% |
| Borresperse[2)] | | | 0,5% | 0,5% | — | '3 |
| Aqanol | 100% | | | | | |
| Solamon | | 100% | | | | |
| VOD (m/s) | F[3)] | F[3)] | 2 400 | F[3)] | 3 100 | 2 900 |

[1)] = Examples according to the invention
[2)] = Sodium lignosulphonate from Orkla ASA
[3)] = Fail (no detonation)

What is claimed is:

1. A sensitized watergel slurry explosive made by the process of first forming a dry ANFO-explosive consisting essentially of one or more thickening agents, one or more inorganic oxidizer salts, one or more organic fuels, and a gas-generating substance; and then placing the dry ANFO-explosive in a bore hole that contains water, whereby the water dissolves part of the oxidizer salts, thickens the thickening agents and causes the gas-generating substance to generate a gas.

2. A slurry explosive according to claim 1 wherein the gas-generating substance includes sodium bicarbonate.

3. A slurry explosive according to claim 1 wherein the gas-generating substance contains an acid as a pH-reducing agent.

4. A method of forming a sensitized watergel slurry explosive in a water-containing bore hole consisting essentially of adding to the bore hole a dry ANFO-explosive comprising one or more inorganic oxidizer salts, one or more organic fuels, one or more thickening agents and a gas-generating substance whereby the water in the bore hole dissolves part of the oxidizer salts, thickens the thickening agents and causes the gas-generating substance to generate a gas.

5. A method according to claim 4 wherein the gas-generating substance includes sodium bicarbonate.

6. A method according to claim 4 wherein the gas-generating substance contains an acid as a pH-reducing agent.

* * * * *